US006431469B2

(12) United States Patent
Lambert et al.

(10) Patent No.: US 6,431,469 B2
(45) **Date of Patent: *Aug. 13, 2002**

(54) FUEL INJECTOR INCLUDING OUTER VALVE NEEDLE AND INNER VALVE NEEDLE SLIDABLE WITHIN A PASSAGE PROVIDED IN THE OUTER VALVE NEEDLE

(75) Inventors: Malcolm David Dick Lambert, Bromley; Paul Buckley, Rainham; Michael Peter Cooke, Gillingham; Godfrey Greeves, Hatch End, all of (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/838,860

(22) Filed: Apr. 20, 2001

Related U.S. Application Data

(63) Continuation of application No. 09/330,784, filed on Jun. 11, 1999, now Pat. No. 6,260,775.

(30) Foreign Application Priority Data

| | | |
|---|---|---|
| Jun. 24, 1998 | (GB) | 9813476 |
| Oct. 16, 1998 | (GB) | 9822516 |
| Nov. 4, 1998 | (GB) | 9824005 |
| Feb. 24, 1999 | (GB) | 9904120 |

(51) Int. Cl.[7] ..... F02M 39/00

(52) U.S. Cl. ..... 239/533.3; 239/533.4; 239/585.5

(58) Field of Search ..... 239/533.3, 533.4, 239/585.5, 533.1, 533.2, 533.9, 533.11, 533.13

(56) References Cited

U.S. PATENT DOCUMENTS

| | | | | | |
|---|---|---|---|---|---|
| 4,151,958 | A | | 5/1979 | Hofmann | |
| 4,205,790 | A | | 6/1980 | Keiczek | |
| 4,339,080 | A | | 7/1982 | Kopse | |
| 4,382,554 | A | | 5/1983 | Hofmann | |
| 4,407,457 | A | | 10/1983 | Seifert | |
| 5,899,389 | A | * | 5/1999 | Pataki et al. | 239/533.3 |
| 6,024,297 | A | * | 2/2000 | Greeves | 239/533.9 |
| 6,220,528 | B1 | * | 4/2001 | Cooke et al. | 239/533.3 |
| 6,260,775 | B1 | * | 7/2001 | Lambert et al. | 239/533.3 |

FOREIGN PATENT DOCUMENTS

| | | |
|---|---|---|
| GB | 2204357 | 11/1988 |

OTHER PUBLICATIONS

Marks' Standard Handbook for Mechanical Engineers, 9$^{th}$ Edition, pp. 5–4 and 5–5.

* cited by examiner

*Primary Examiner*—Lesley D. Morris
*Assistant Examiner*—Dinh Q. Nguyen
(74) *Attorney, Agent, or Firm*—Wells St. John P.S.

(57) ABSTRACT

A fuel injector comprises a first needle, and a second needle slidably within a passage formed in the first needle. The needles are engageable with respective seatings to control fuel delivery through respective groups of outlet openings. Load transmitting means are provided whereby movement of the first needle can be transmitted to the second needle. Also described is an injector in which a second needle is provided with formations defining an integral resilient biasing arrangement.

8 Claims, 13 Drawing Sheets

FUEL INJECTOR INCLUDING OUTER VALVE NEEDLE AND INNER VALVE NEEDLE SLIDABLE WITHIN A PASSAGE PROVIDED IN THE OUTER VALVE NEEDLE

This is a Continuation of U.S. patent application Ser. No. 09/330,784, filed Jun. 11, 1999, and titled "Fuel Injector Including Outer Valve Needle and Inner Valve Needle Slidable Within a Passage Provided in the Outer Valve Needle", which is now U.S. Pat. No. 6,260,775.

This invention relates to a fuel injector for use in supplying fuel, under pressure, to a combustion space of a compression ignition internal combustion engine.

In order to reduce emissions levels and noise, it is known to provide fuel injectors in which the total area of the openings through which fuel is delivered can be varied, in use. One technique for achieving this is to use two valve needles, one of which is slidable within a bore provided in the other of the needles to control the supply of fuel to some of the outlet openings independently of the supply of fuel to others of the outlet openings.

Such arrangements have the disadvantages that fuel may be able to flow between the inner and outer needles giving rise to substantially continuous delivery of fuel at a low rate. Further in order to control the movement of the inner and outer needles, separate actuators may be required resulting in the injector being of increased complexity.

According to the present invention there is provided an injector comprising a first, outer valve needle, a second, inner valve needle slidable within a passage provided in the outer valve needle, and load transmitting means whereby movement of the outer valve needle can be transmitted to the inner needle.

The load transmitting means may comprise a shoulder associated with the first needle which is engageable with an enlarged diameter region of the second valve needle to restrict movement of the second needle relative to the first needle such that movement of the first needle beyond a predetermined distance causes movement of the second needle.

The shoulder is conveniently defined by an end of a tubular sleeve carried by the first needle and defining part of the passage within which the second needle is reciprocable. The sleeve may project beyond an end of the first needle, and may be arranged to engage the first seating.

Alternatively, the shoulder may be defined by a stepped region of a bore formed in the first needle and defining the passage, the enlarged diameter region of the second needle being compressible to permit assembly.

The inner needle is preferably resiliently biased towards the second seating.

The inner needle is conveniently resiliently biased by a spring.

The biasing of the inner needle ensures that, at the commencement of movement of the outer needle away from the first seating, the inner needle is in engagement with the second seating. Undesirable delivery of fuel through the second outlet opening can thus be avoided.

In an alternative arrangement, the second valve needle is provided with a plurality of flexible members which are deformable between a deformed state and an undeformed state, whereby in the undeformed state the flexible members define the enlarged diameter region of the second valve needle and engage with the shoulder associated with the passage to restrict movement of the second valve needle relative to the first valve needle.

The provision of a second valve needle with a plurality of flexible members provides the advantage that no tubular sleeve component is required. Furthermore, deformation of the flexible members into the deformed state enables insertion of the second valve needle into the passage. Assembly of the fuel injector is therefore simplified and manufacturing costs are reduced.

The second valve needle conveniently comprises an upper body portion and a lower body portion, the flexible members being formed along the length of lower body portion. Preferably, the second valve needle comprises four flexible members defined by apertures formed in the lower body portion of the second valve needle, the flexible members therefore being integrally formed with the second valve needle.

The second valve needle may further include integral resilient bias means for resiliently biasing the second valve needle towards the second seating. For example, the upper body portion of the second valve needle may have a plurality of recesses formed therein, the upper body portion thereby providing a spring function to resiliently bias the second valve needle towards the second seating. The recesses are preferably formed on alternate sides of the second valve needle along the length of the upper body portion.

By integrally forming the resilient bias means with the second valve needle, the number of fuel injector parts is reduced and manufacture and assembly of the fuel injector is simplified.

The load transmitting means may, alternatively, take the form of a pin carried by one of the needles, the pin extending through a slot provided in the other of the needles such that movement of the outer needle beyond a predetermined position can be transmitted to the inner needle. Clearly, in such an arrangement, movement of the inner needle is dependent upon the distance moved by the outer needle, which can be controlled by a single actuator. In an alternative arrangement, such control of movement of the inner needle to be dependent upon the distance moved by the outer needle can be achieved using a hydraulic link rather than using a pin.

In a further alternative arrangement, the load transmitting means may take the form of a hydraulic link arranged such that movement of the inner needle is dependent upon the rate of movement of the outer needle. The hydraulic link conveniently comprises a chamber defined between the inner and outer needles, the chamber communicating through a restricted flow path with a source of fuel under pressure. In use, if the outer needle lifts slowly, fuel is able to flow to the chamber at a sufficiently high rate to prevent movement of the inner needle. Movement of the outer needle at a higher rate is transmitted to the inner needle as fuel cannot flow to the chamber at a rate sufficient to keep the inner needle in engagement with its seating.

According to a second aspect of the invention there is provided a fuel injector comprising a first valve needle reciprocable within a bore formed in a nozzle body and cooperable with a first seating to control the supply of fuel to a first fuel outlet and a second valve needle reciprocable within a passage located within the first valve needle and cooperable with a second seating to control the supply of fuel to a second fuel outlet, the second valve needle comprising resilient bias means for resiliently biasing the second valve needle towards the second seating, the resilient bias means being integrally formed with the second valve needle.

The invention will further be described, by way of example, with reference to the accompanying drawings, in which.

Figure 1:
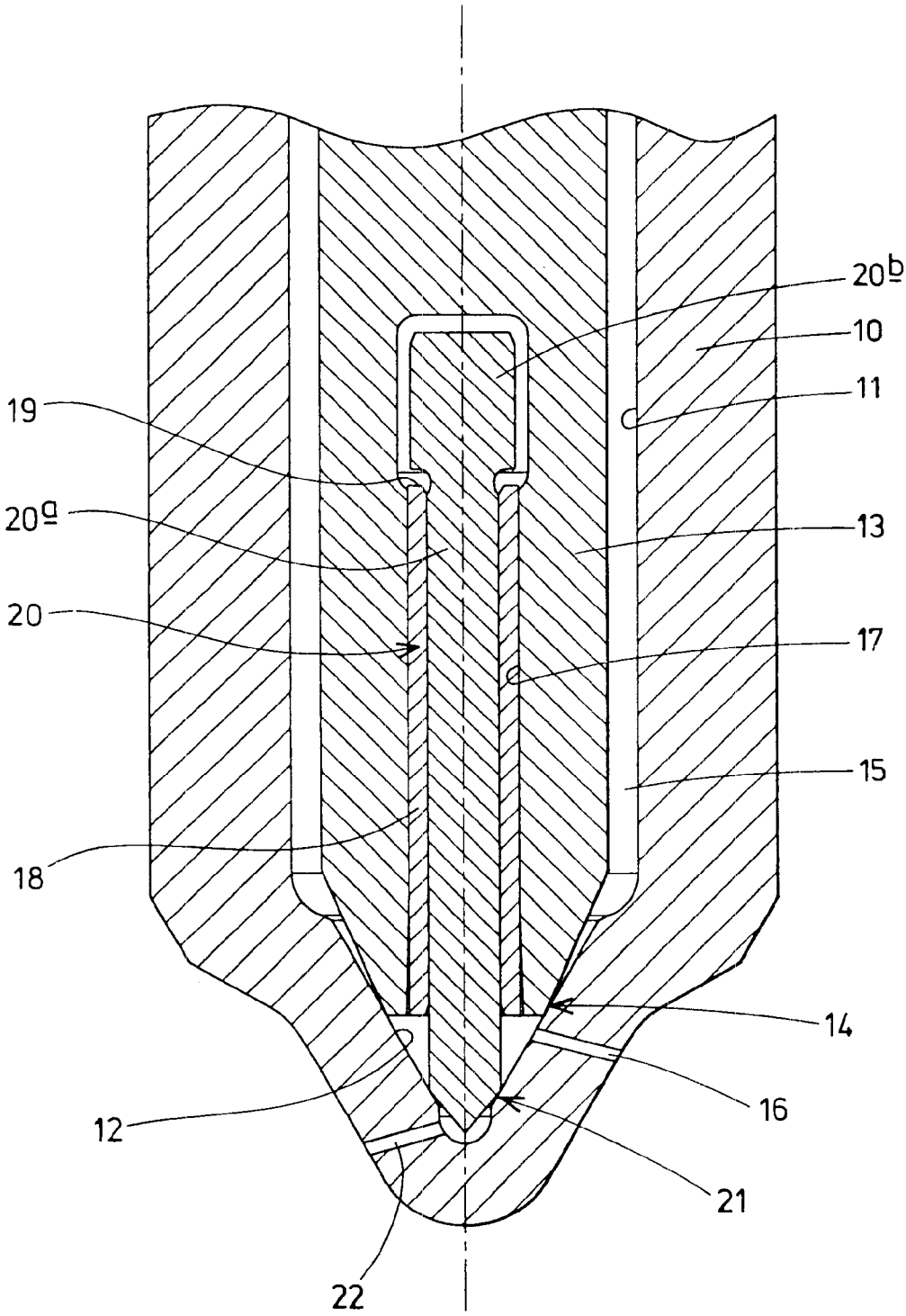
FIG. 1 is a sectional view of part of a fuel injector in accordance with an embodiment of the invention.

The fuel injector illustrated, in part, in FIG. 1 comprises a nozzle body 10 provided with a blind bore 11 including, adjacent its blind end, a frusto-conical seating surface 12. A first, outer valve needle 13 is reciprocable within the bore 11, the valve needle 13 including regions (not shown) of diameter substantially equal to the diameter of the adjacent parts of the bore 11, and arranged to guide the first needle 13 for sliding movement within the bore 11.

The first needle 13 is shaped for engagement with the surface 12, the surface 12 defining a first seating 14 with which the first needle 13 is engageable to control communication between a delivery chamber 15 defined between the first needle 13 and the bore 11 and a group of first outlet openings 16 (only one of which is shown) located downstream of the seating 14.

The first needle 13 is provided with a blind drilling 17 within which a tubular sleeve 18 is located. As illustrated in FIG. 1, the tubular sleeve 18 does not extend to the blind end of the drilling 17, thus the presence of the sleeve 18 within the drilling 17 results in the definition of a passage having a region defined by the sleeve 18 of relatively small diameter, and a larger diameter region adjacent the blind end of the drilling 17. A shoulder or step 19 is defined at the interconnection of the relatively small diameter and large diameter parts of the passage, the step 19 being defined by an end of the sleeve 18.

A second, inner valve needle 20 is slidable within the passage defined in the first valve needle 13. The second valve needle 20 includes a relatively small diameter, elongate region 20*a* which is slidable within the passage defined by the tubular sleeve 18, and a larger diameter region 20*b* which is engageable with the step 19 to limit movement of the second needle 20 relative to the first needle 13. The second needle 20 is shaped, at its end which is cooperable with the surface 12, to be of frusto-conical form, the surface 12 defining a seating 21 with which the second needle 20 is engageable to control the supply of fuel to a group of second outlet openings 22 (only one of which is shown) located downstream of the second seating 21.

Clearly, assembly of the first and second valve needles 13, 20 and the sleeve 18 requires the second valve needle 20 to be introduced into the drilling 17 of the first valve needle 13, and subsequently for the tubular sleeve 18 to be introduced, the tubular sleeve 18 retaining the second valve needle 20 within the drilling 17. The tubular sleeve 18 is conveniently an interference fit within the drilling 17, and a small clearance is conveniently defined between the tubular sleeve 18 and the inner valve needle 20 to permit fuel to flow to or from the blind end of the drilling 17, thus preventing the second valve needle 20 from becoming held in any particular position relative to the first needle 13 due to the formation of a hydraulic lock.

In use, fuel under high pressure is applied to the delivery chamber 15, and any suitable technique is used for controlling movement of the first valve needle 13 relative to the nozzle body 10. For example, the first valve needle 13 may be held in engagement with the first seating 14 by the fluid pressure within a control chamber, the fluid pressure within the control chamber being controlled by, for example, a piezoelectric actuator arrangement acting upon an appropriate piston. It will be appreciated, however, that alternative control arrangements may be used.

It will be appreciated that when the first valve needle 13 is held in engagement with the first seating 14, fuel is unable to flow from the delivery chamber 15 past the first seating 14, thus fuel cannot be delivered through either the first outlet openings 16 or the second outlet openings 22.

In order to commence fuel injection, the first valve needle 13 is lifted from the first seating 14. The movement of the first needle 13 permits fuel to flow past the first seating 14, thus fuel is able to flow to the group of first outlet openings 16, and injection of fuel through these outlet openings commences. The movement of the first needle 13 is only by a small distance, and the enlarged region 20*b* of the second needle 20 does not engage the step 19, thus movement of the first needle 13 is not transmitted to the second needle 20. Fuel is able to flow between the second needle 20 and the sleeve 18, pressurizing the blind end of the drilling 17 and applying a relatively large magnitude force to the enlarged region 20*b* of the second needle 20 to ensure that the second needle 20 remains in engagement with the second seating 21. As a result, fuel is not injected through the group of second outlet openings 22. As fuel is only delivered through the first outlet openings 16, it will be appreciated that the fuel injection rate is relatively low.

In the event that the second needle 20 does lift from the second seating 21, the reduced fuel pressure acting upon the lower end of the needle 20 due to the flow of fuel through the second openings 22 and due to the throttling effect of the second needle 20 and the second seating 21 will result in the second needle 20 moving into engagement with the second seating 21 due to the pressure of the fuel acting upon the enlarged diameter region 20*b* of the second needle 20.

If, subsequently, the first needle 13 is lifted from the first seating 14 by a further distance, the step 19 moves into engagement with the enlarged region 20*b* of the second needle 20, and further movement of the first needle 13 will result in the second needle 20 being lifted from the second seating 21. Such movement permits fuel to flow past the second seating 21 to the group of second outlet openings 22. As a result, fuel is injected through both the group of first outlet openings 16 and the group of second outlet openings 22. It will be appreciated that as fuel is injected through both groups of outlet openings 16, 22, fuel is injected at a second, higher rate.

When injection is to be terminated, the first needle 13 is returned into engagement with the first seating 14. As a result, fuel is no longer able to flow from the delivery chamber 15 past the seating 14, thus injection of fuel through both groups of outlet openings 16, 22 will cease. Indeed as, at the commencement of movement of the first needle 13 towards the first seating 14, the enlarged region 20*b* of the second needle 20 is in engagement with the step 19, it will be appreciated that the second needle 20 moves into engagement with the second seating 21 before the first needle 13 moves into engagement with the first seating 14. It will therefore be appreciated that fuel supply to the group of second outlet openings 22 ceases prior to the termination of fuel supply to the group of first outlet openings 16.

Figure 2:
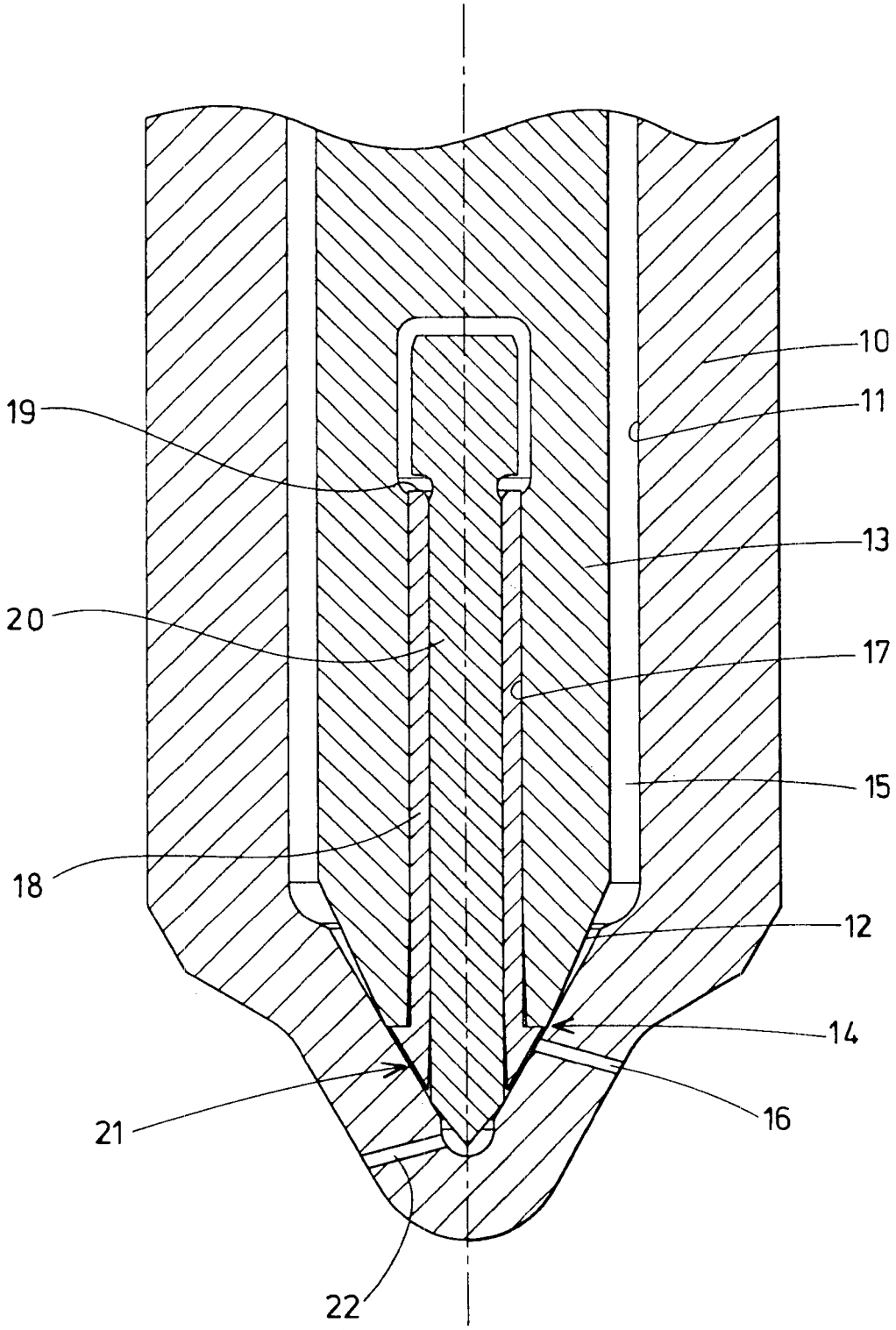
FIGS. 2 to 5 illustrate four alternative embodiments.

The embodiment illustrated in FIG. 2 is similar to that of FIG. 1 and so will not be described in great detail. The distinction between the arrangement of FIG. 2 and that of FIG. 1 is that the tubular sleeve 18 is shaped to include a region 18*a* which projects beyond the lower end of the needle 13, in the orientation illustrated, thus reducing the dead volume downstream of the first seating 14. As a result, upon movement of the first needle 13 into engagement with the first seating 14, injection will cease rapidly, in a relatively controlled manner. The region 18*a* may also serve to cover the outlet openings 16.

Figure 3:
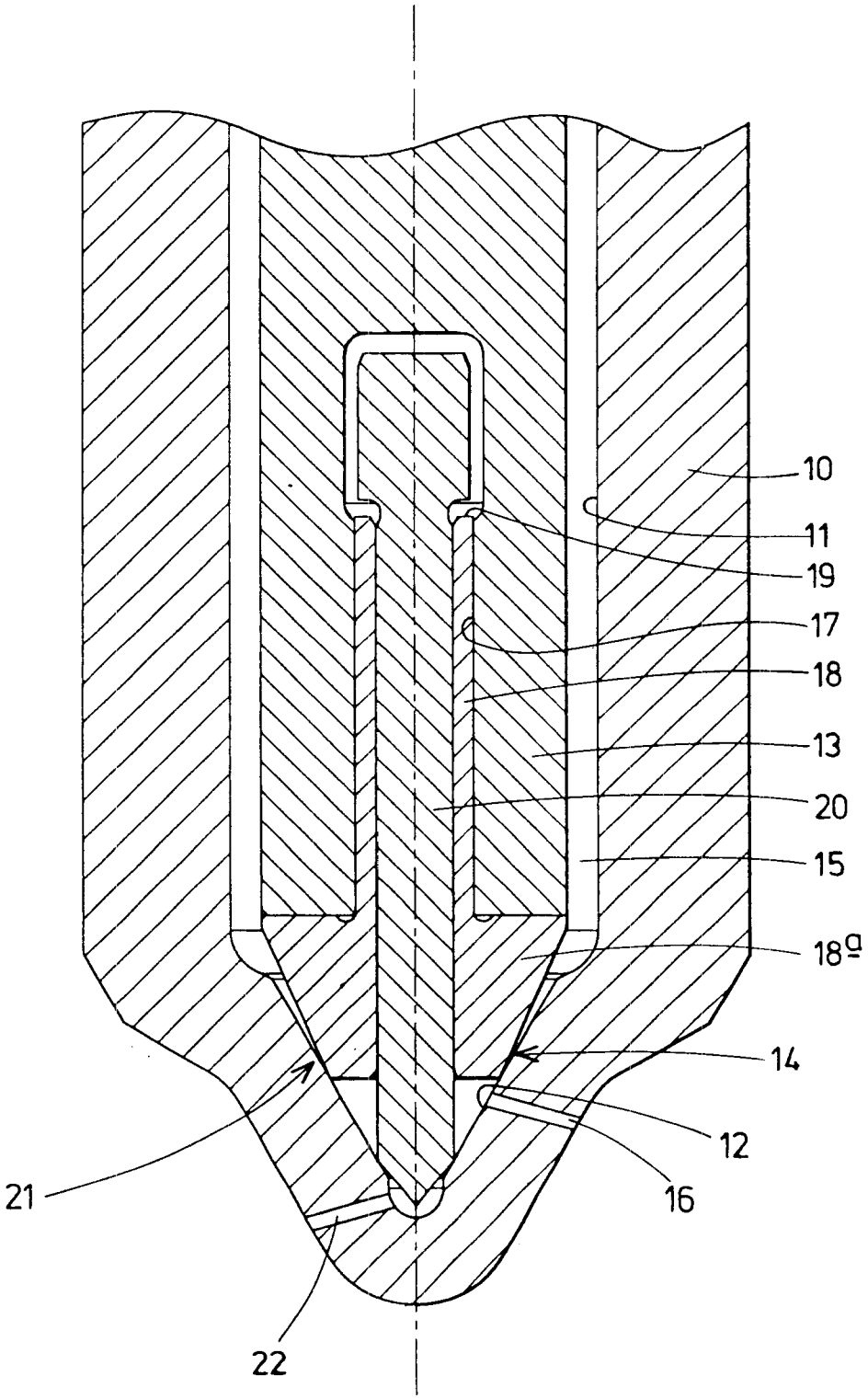

The arrangement illustrated in FIG. 3 differs from that of FIG. 2 in that the region 18*a* is of increased axial length, and is engageable with the first seating 14. As a result, by constructing the sleeve 18 of an appropriate material, a valve needle can be provided in which the part thereof which is engageable with the seating is constructed of a harder material than the remainder of the needle. Clearly, in the arrangement illustrated in FIG. 3, it is important to ensure that a substantially fluid tight seal is provided between the sleeve 18 and the first needle 13, as if fuel is able to flow between these components, the injector may leak. If there is any leakage, then the fuel pressure within the delivery chamber 15 must be greater than that within the drilling 17, and the seal is thus augmented.

Figure 4:
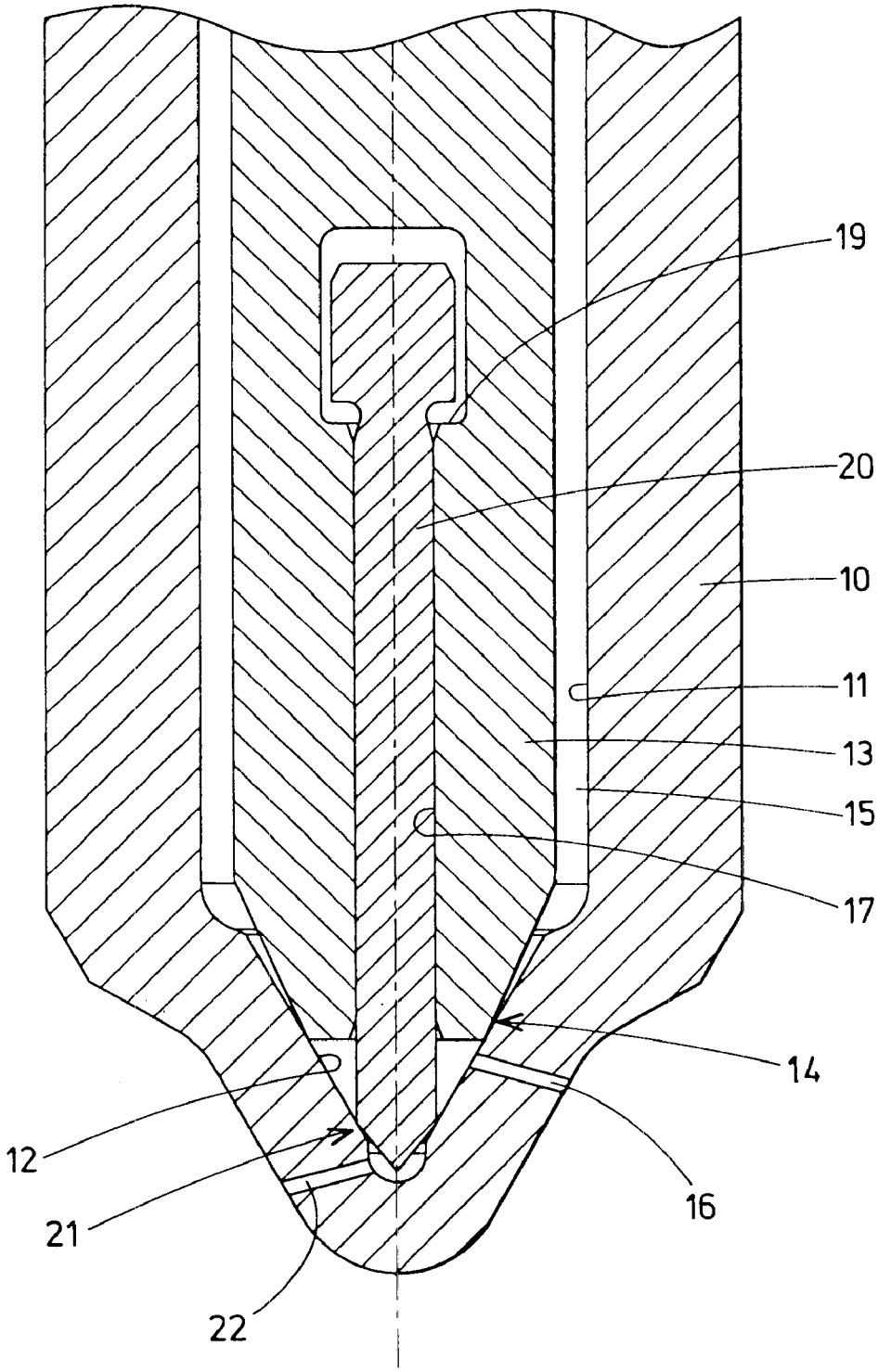

FIG. 4 illustrates a further alternative arrangement, the arrangement of FIG. 4 omitting the sleeve 18. Instead of providing the sleeve 18 defining the step 19, the drilling 17 is shaped to define the passage and the step 19. In order to permit assembly of such an arrangement, the second valve needle 20 is conveniently constructed of a material and form which is sufficiently compressible to permit the enlarged end region 20*b* thereof to be compressed and pushed through the drilling 17 to the enlarged, blind end thereof, the enlarged region 20*b* then expanding to an extent sufficient to restrict movement of the second needle 20 relative to the first needle 13. It will be appreciated that the enlarged region 20*b* of the second needle 20 need not be of circular cross-section, and if, upon completion of assembly, the enlarged region 20*b* of the second needle 20 is not restored exactly to its original shape, this is of little significance.

In each of the embodiments described hereinbefore, the enlarged region 20*b* of the second needle 20 is conveniently shaped to ensure that, when the enlarged region 20*b* engages the step 19, communication between the blind end of the drilling 17 and the part of the passage of smaller diameter is maintained.

Each of the embodiments described hereinbefore may be modified by including an additional valve needle slidable within a bore formed in the second valve needle 20, the additional valve needle being cooperable with a respective seating to control injection of fuel through a group of third outlet openings. Indeed, further valve needles could be provided if desired.

Figure 5:
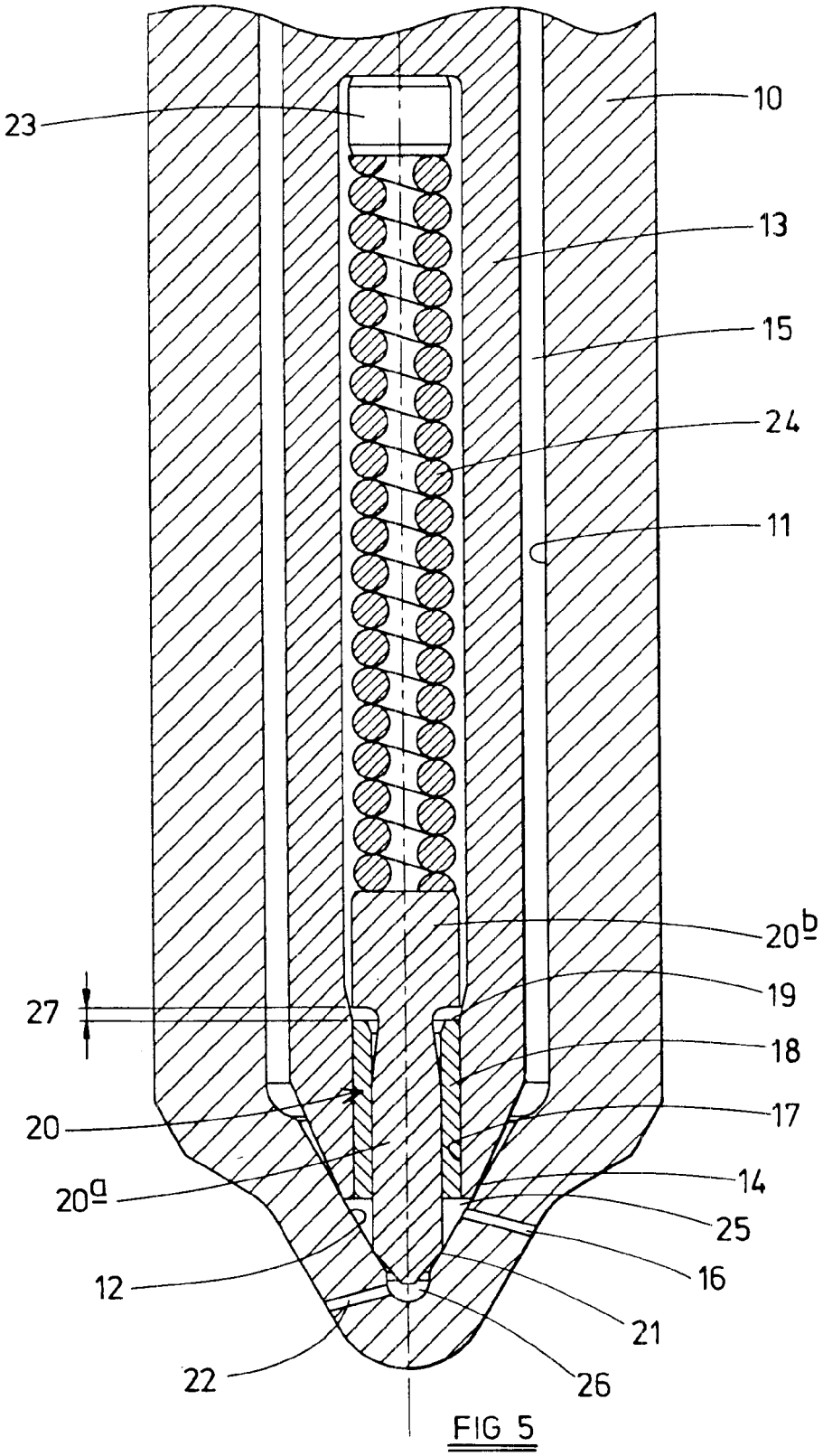

In the modification illustrated in FIG. 5, a shim 23 is located at the blind end of the bore 17, a spring 24 abutting the shim 23. The spring 24 is engaged between the shim 23 and an end surface of an inner valve needle 20. The spring 24 biases the inner valve needle 20 towards a position in which an end surface of the inner valve needle 20 cooperates with the seating surface 12 to control communication between a chamber 25 located downstream of the first seating 14 and a chamber 26 located downstream of the second seating 21. A second outlet opening 22 communicates with the chamber 26. It will be appreciated that if desired a plurality of such second outlet openings 22 may be provided, each outlet opening 22 communicating with the chamber 26.

The spring 24 ensures that whilst the outer needle 13 engages the seating surface 12 and whilst it is spaced therefrom by only a small distance (less than distance 27 in FIG. 5), the inner needle 20 is held in engagement with the seating surface 12.

Although in the description hereinbefore, the inner valve needle 20 is biased towards the second seating line 21 by means of a helical compression spring 24, it will be appreciated that any other type of resilient biasing arrangement could be used. It will further be appreciated that, if desired, the inner valve needle 20 may itself be provided with a bore within which a further valve needle is slidable to control delivery of fuel through one or more further outlet openings or groups of outlet openings.

It will be appreciated that a spring could be incorporated into any of the embodiments described hereinbefore.

Figure 6:
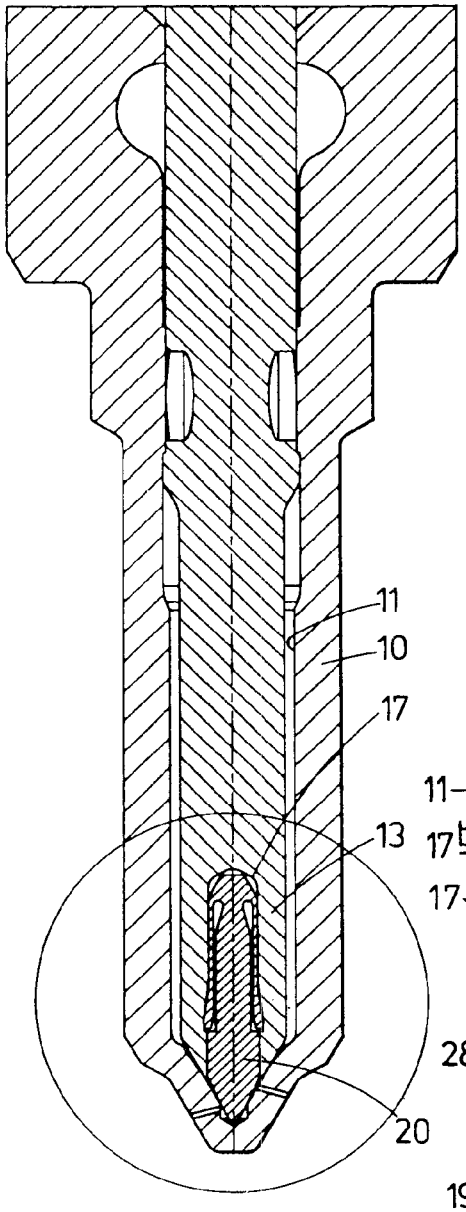
FIG. 6 is a sectional view of part of an alternative fuel injector.
Figure 7:
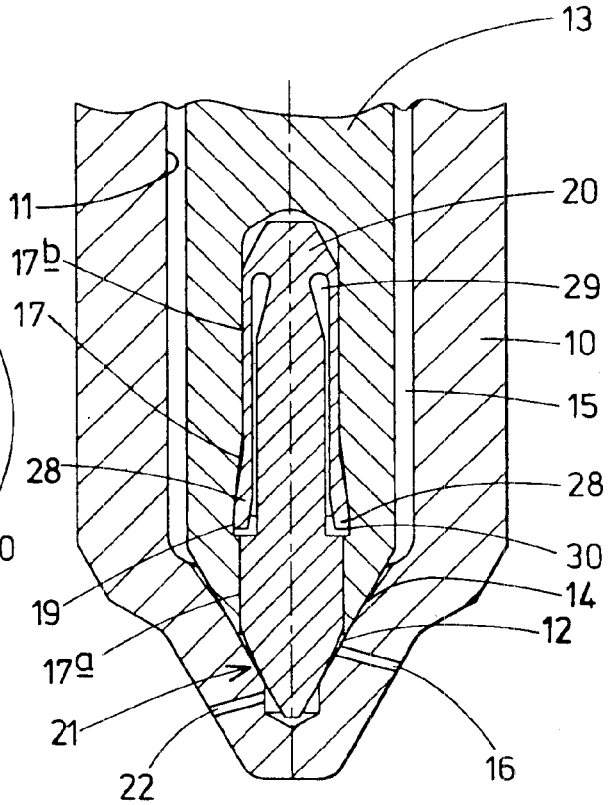
FIG. 7 is an enlarged sectional view of a part of the fuel injector shown in FIG. 6.

Referring to FIGS. 6 and 7, an alternative fuel injector comprises a nozzle body 10 provided with a blind bore 11 including, adjacent its blind end, a frusto-conical surface 12. A first, outer valve needle 13 is reciprocable within the bore 11 and is arranged for sliding movement within the bore 11.

The first valve needle 13 is shaped for engagement with the surface 12, the surface 12 defining a first seating 14 with which the first valve needle 13 is engageable to control communication between a delivery chamber 15, defined between the first valve needle 13 and the bore 11, and a first group of fuel outlets 16 (only one of which is shown) located downstream of the seating 14.

The first valve needle 13 is reciprocable within the bore 11 under the control of an appropriate control arrangement (not shown) which controls the distance through which the first valve needle 13 can move away from the first seating 14. The control arrangement may comprise, for example, a piezoelectric actuator arrangement which includes a piezoelectric actuator element or stack which cooperates with a piston member to control the fluid pressure within a control chamber. Such a control arrangement would be familiar to a person skilled in the art. The injector also comprises a second, inner valve needle 20 slidable within a passage 17 defined in the first valve needle 13. The second valve needle 20 is shaped, at its end which is cooperable with the surface 12, to be of frusto-conical form. The surface 12 defines a seating 21 with which the second valve needle 20 is engageable to control the supply of fuel to a second group of fuel outlets 22 (only one of which is shown). The passage 17 differs from some of the arrangements described hereinbefore in that it has a region 17*a* of relatively small diameter towards the frusto-conical surface and a larger diameter region 17*a*, the interconnection between the relatively small diameter region 17*b* and the larger diameter region 17*b* defining a shoulder or step 19 in the passage 17.

Figure 8:
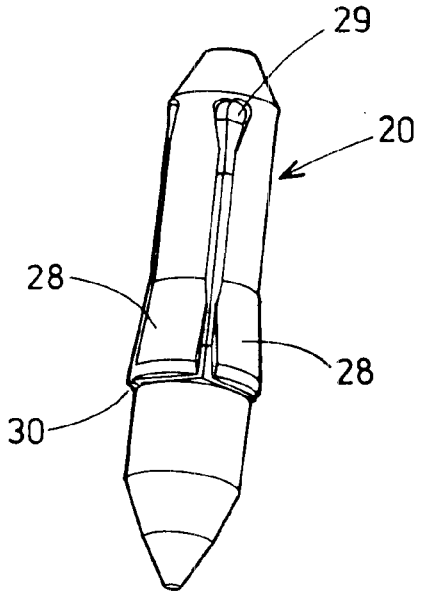
FIG. 8 is a diagram illustrating the second valve needle of the fuel injector in FIGS. 6 and 7.

The second valve needle 20 is provided with four downwardly extending flexible members 28 (only two of which are shown in FIGS. 6 to 8) spaced circumferentially around the second valve needle 20. The flexible members 28 are formed by forming slots or apertures 29 in the second valve needle 20 such that the flexible members 28 form an integral part of the second valve needle 20. A small clearance is conveniently defined between the flexible members 28 of the second valve needle 20 and the passage 17 to permit fuel to flow to or from the blind end of the passage 17, thus preventing the second valve needle 20 from becoming held in any particular position relative to the first valve needle 13 due to the formation of a hydraulic lock.

The flexible members 28 are deformable between a first, undeformed state and a second, deformed state, the flexible members naturally adopting the undeformed state. Referring to FIG. 8, it can be seen that when in the undeformed state the flexible members 28 provide a step 30 on the surface of the second valve needle 20.

In order to assemble the fuel injector, the flexible members 28 can be flexed inwardly such that they adopt the deformed state, whereby the step 30 on the surface of the second valve needle 20 is removed or reduced sufficiently to enable insertion of the second valve needle 20 into the passage 17 through the region 17*a* of reduced diameter. Upon reaching the step 19 in the passage 17 the flexible members 28 flex outwardly into the region 17*b* of increased diameter, thus reverting to their undeformed state. The flexible members 28 thereby serve to limit movement of the second valve needle 20 within the passage 17 by virtue of the engagement of step 30, provided by the flexible members 28 in their undeformed state, with the step 19 in the passage 17.

Operation of the injector is as described hereinbefore and so will not be described in further detail.

In the arrangement illustrated in FIGS. 6 to 8, prior to commencement of injection, the second valve needle 20 is free to move and may occupy a position in which it is spaced from the seating 21. In such circumstances, upon commencement of movement of the first valve needle 13, there may be a brief period during which fuel is injected through the second group of fuel outlets 22 downstream of the second seating 21. Although eventually the pressure drop across the second valve needle 20 will cause movement of the second valve needle 20 into engagement with the second seating 21, any initial injection through the second group of fuel outlets 22 can be undesirable.

This problem may be alleviated by locating a spring in the upper end of the passage 17 to resiliently bias the second valve needle 20 towards the second seating 21, for example as illustrated in FIG. 5. The biasing of the second valve needle 20 towards the second seating ensures that, on commencement of movement of the first valve needle 13 away from the first seating 14, the second valve needle 20 is in engagement with the second seating 21. Undesirable delivery of fuel through the second group of fuel outlets 22 is thereby avoided.

Figure 9:
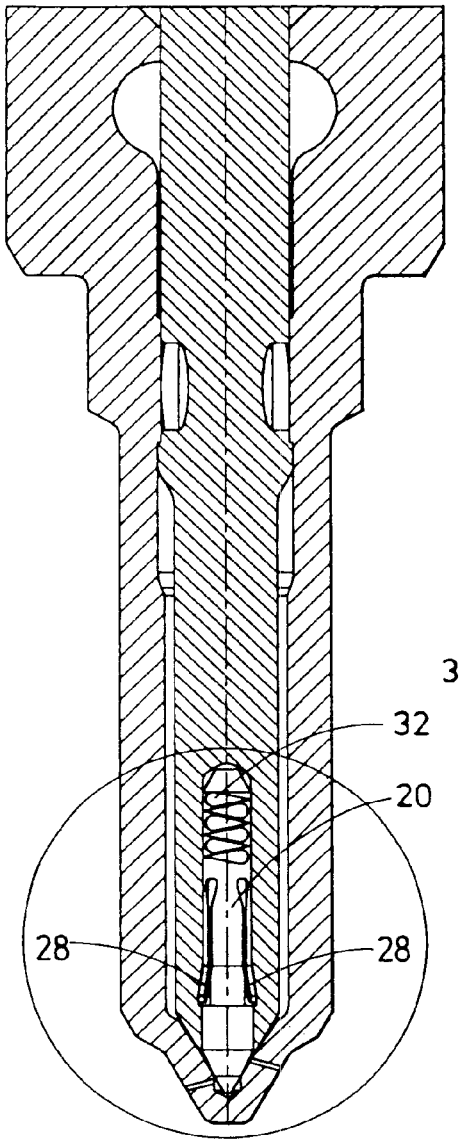
FIG. 9 is a sectional view of part of a further alternative fuel injector.
Figure 11:
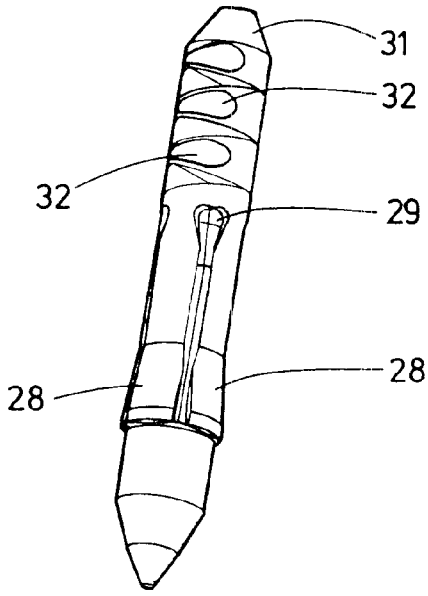
FIG. 11 is a diagram illustrating the second valve needle of the fuel injector of FIGS. 9 and 10.
Figure 10:
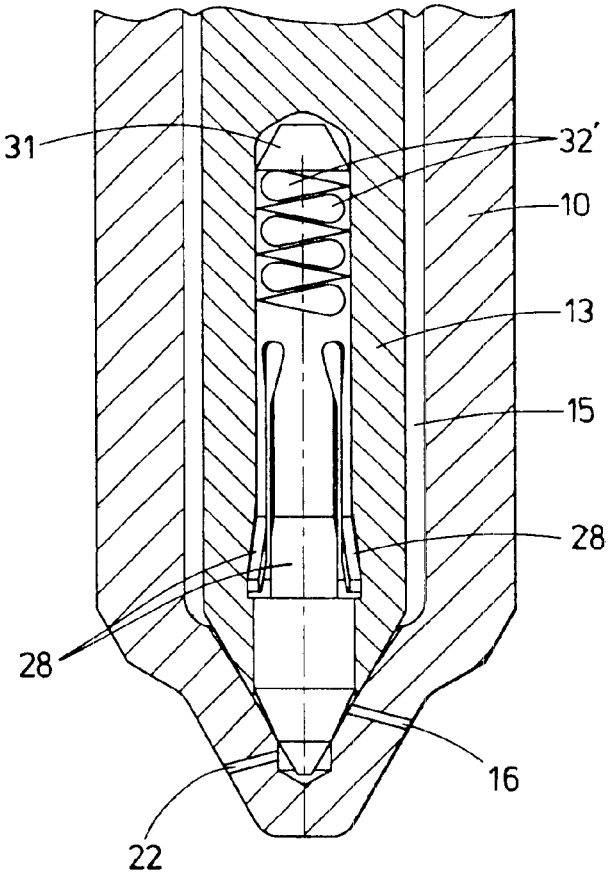
FIG. 10 is an enlarged sectional view of a part of the fuel injector shown in FIG. 9.

Alternatively, referring to FIGS. 9 to 11, the inner valve needle 20 may be provided, at its upper end, with an upper body portion 31 in which slots or apertures 32 are formed so that the upper body portion 31 functions as a spring. The second valve needle 20 therefore comprises integrally formed resilient bias means for resiliently biasing the second valve needle 20 towards the second seating 21. This provides the advantage that the fuel injector has a reduced number of parts, the integral forming of the spring in the upper body portion 31 removing the need for a separate spring located within the passage 17.

The volume of material removed from the upper body portion 31 of the second valve needle 20 to form the apertures 32 is preferably kept to a minimum so as to minimise the dead volume above the second needle valve 20 and thereby optimise the performance of the fuel injection cycle. In particular, the geometry of the apertures 32 should preferably be such that stresses in the second valve needle 20 are minimised and sufficient rigidity of the valve needle 20 is maintained. A suitable geometry is shown in FIGS. 9 to 11, in which the apertures 32 are formed on alternate sides of the inner valve needle 20 along the length of the upper body portion 31. The apertures 32 may be formed in the upper body portion 31 by means of a wire erosion process.

It will be appreciated that any number of flexible members 28 may be spaced circumferentially around the second valve needle 20 and the number need not be limited to four. The flexible members must, however, be sufficiently rigid to ensure that, upon movement of the first valve needle 13 away from the seating 14, engagement between the step 19 of the passage 17 and the flexible members 28 imparts movement to the second valve needle 20, thereby moving the second valve needle away from the second seating 21.

The embodiments described with reference to FIGS. 6 to 11 may be modified by including one or more additional valve needles slidable within bores formed in the second, inner valve needle, the additional valve needle being cooperable with respective seatings to control injection of fuel through further groups of fuel outlets.

Figure 12:
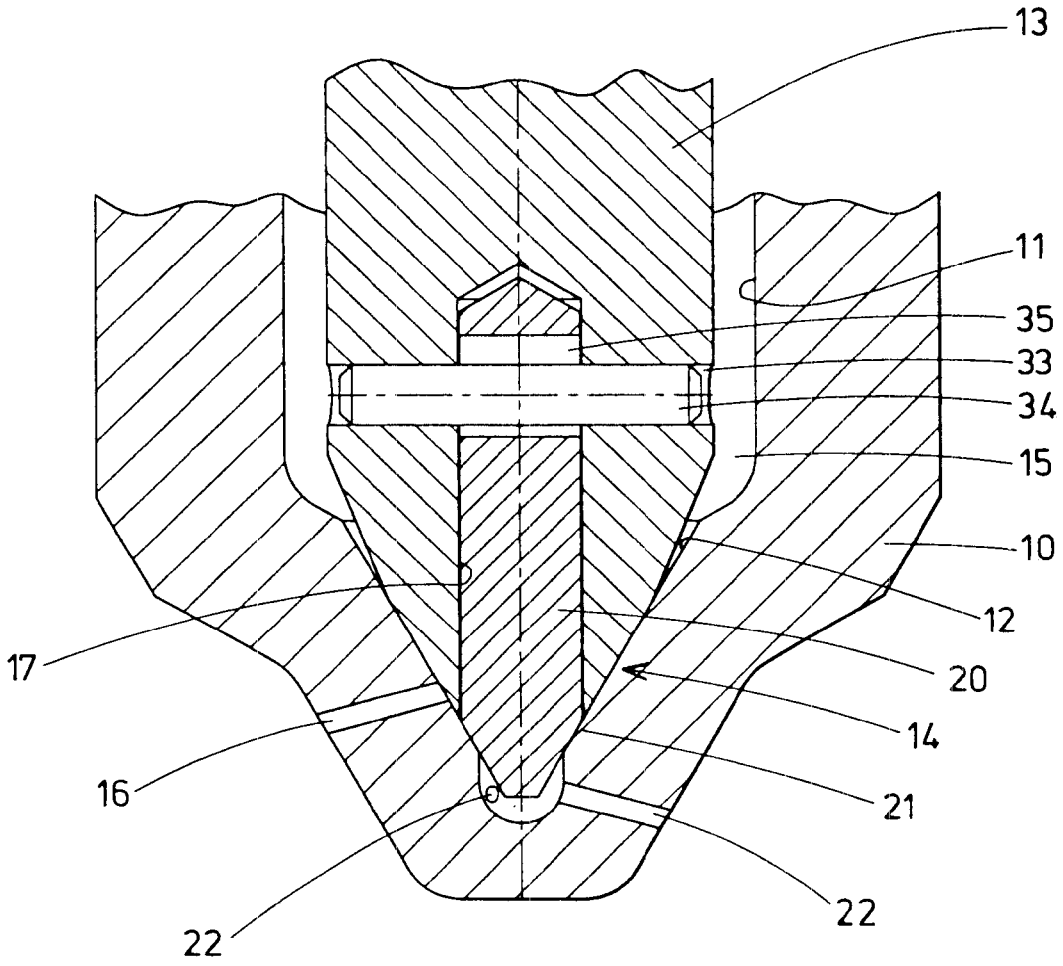
FIGS. 12 to 17 are views illustrating further embodiments.

In the arrangement illustrated in FIG. 12, cross drilling 33 is formed in the outer valve needle 13, a pin 34 being located within the cross drilling 33. The inner valve needle 20 is of diameter slightly smaller than that of the passage or bore 17, and includes, adjacent its upper end, a slot 35 through which the pin 34 extends.

The injector may be controlled using any appropriate control technique which permits control of the distance through which the outer valve needle 13 moves away from the frusto-conical region of the bore 11, in use. For example, the movement of the outer valve needle 13 may be controlled using an appropriate piezoelectric actuator arrangement.

In use, when injection is to commence, the outer valve needle 13 is permitted to move away from the seating, permitting fuel to flow from the chamber 15 to the first group of outlet openings 16. During this stage of the operation of the injector, fuel can flow between the inner and outer needles to maintain the fuel pressure within the bore 17 applied to the upper end surface of the inner valve needle 20 at a sufficient level to ensure that the inner valve needle 20 remains in engagement with the seating, thus preventing injection through the second group of outlet openings 22. Provided the outer valve needle 13 moves only through a small distance, the inner valve needle 20 does not move, thus injection does not occur through the second group of outlet openings 22. However, if the outer valve needle 13 moves beyond a predetermined position, then the pin 34 reaches the upper end of the slot 35, and any further movement of the outer valve needle 13 is transmitted through the pin 34 to the inner valve needle 20, lifting the inner valve needle 20 away from the seating to permit fuel to be delivered through both the first group of outlet openings 16 and the second group of outlets openings 22.

When injection is to be terminated, if movement of the inner valve needle 20 has taken place, then it will be appreciated that the inner valve needle 20 moves into engagement with the seating before the outer valve needle 13 engages the seating. As a result, it is ensured that during subsequent injections, the initial part of the injection occurs only through the first group of outlet openings 16.

Figure 13:
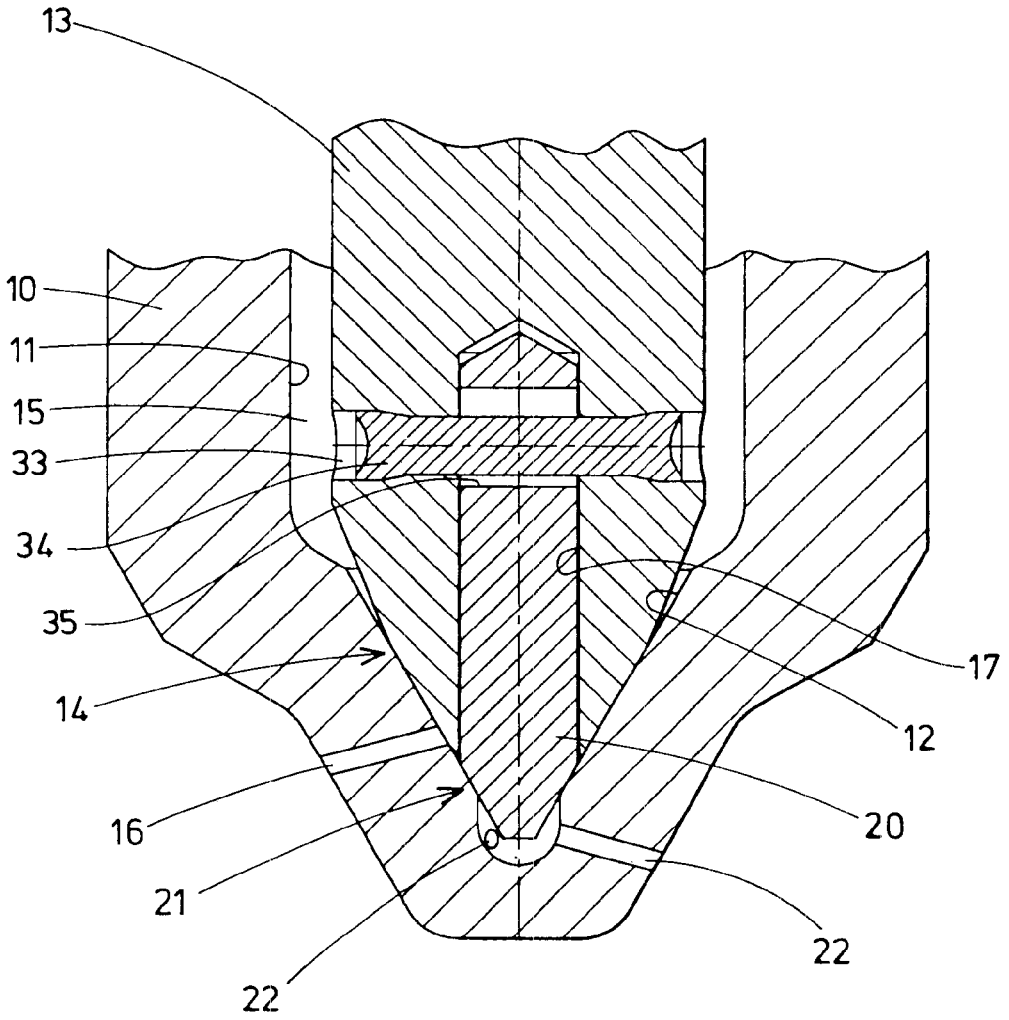

The pin 34 is a substantially fluid tight seal within the drilling 33, thus it will be appreciated that when the outer valve needle 13 engages the seating, fuel is unable to flow to the outlet openings. The pin 34 may be an interference fit within the drilling 33, or may be welded in position. Alternatively, as illustrated in FIG. 13, the pin 34 may be deformed after insertion into the drilling 33 to retain the pin 34 in position and to ensure that a fluid tight seal is formed between the pin 34 and the outer valve needle 13. As shown in FIG. 13, where deformation of the pin 34 is to take place during assembly, the drilling 33 is of a non-uniform diameter.

Figure 14:
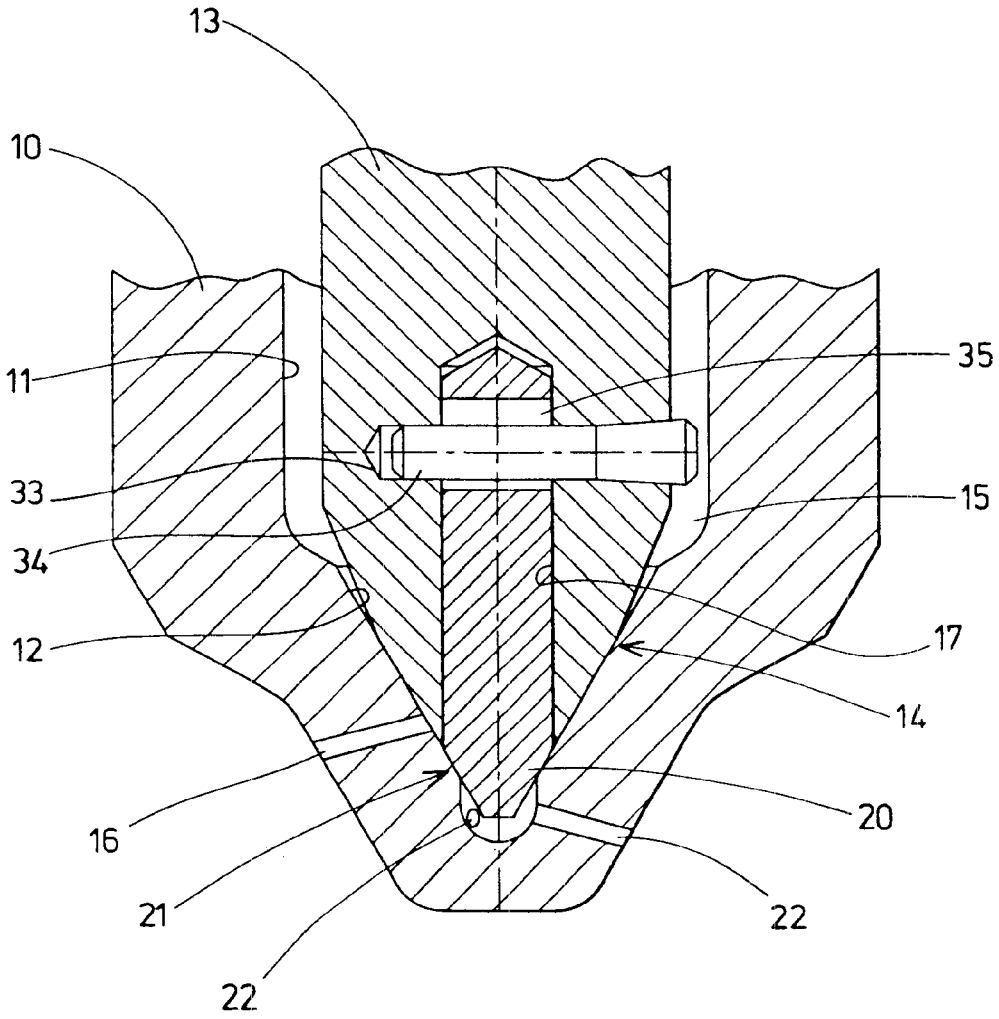

FIG. 14 illustrates a further modification in which the drilling 33 does not extend across the complete diameter of the outer valve needle 13, but rather stops short of one side of the outer valve needle 13. It will be appreciated, that the risk of leakage between the pin 34 and the outer valve needle 13 is thus reduced. The drilling is conveniently of tapered form, the pin being shaped to conform with the drilling. It will be appreciated that the fuel pressure difference across the pin assists in maintaining the pin in position, and that the manufacturing process is simplified.

Although in the embodiments illustrated in FIGS. 12 to 14, the inner valve needle is of diameter smaller than that of the bore 17, it will be appreciated that these diameters may be substantially equal, one or more grooves or flats being provided in the inner valve needle 20 to permit fuel flow within the bore 17.

Figure 15:
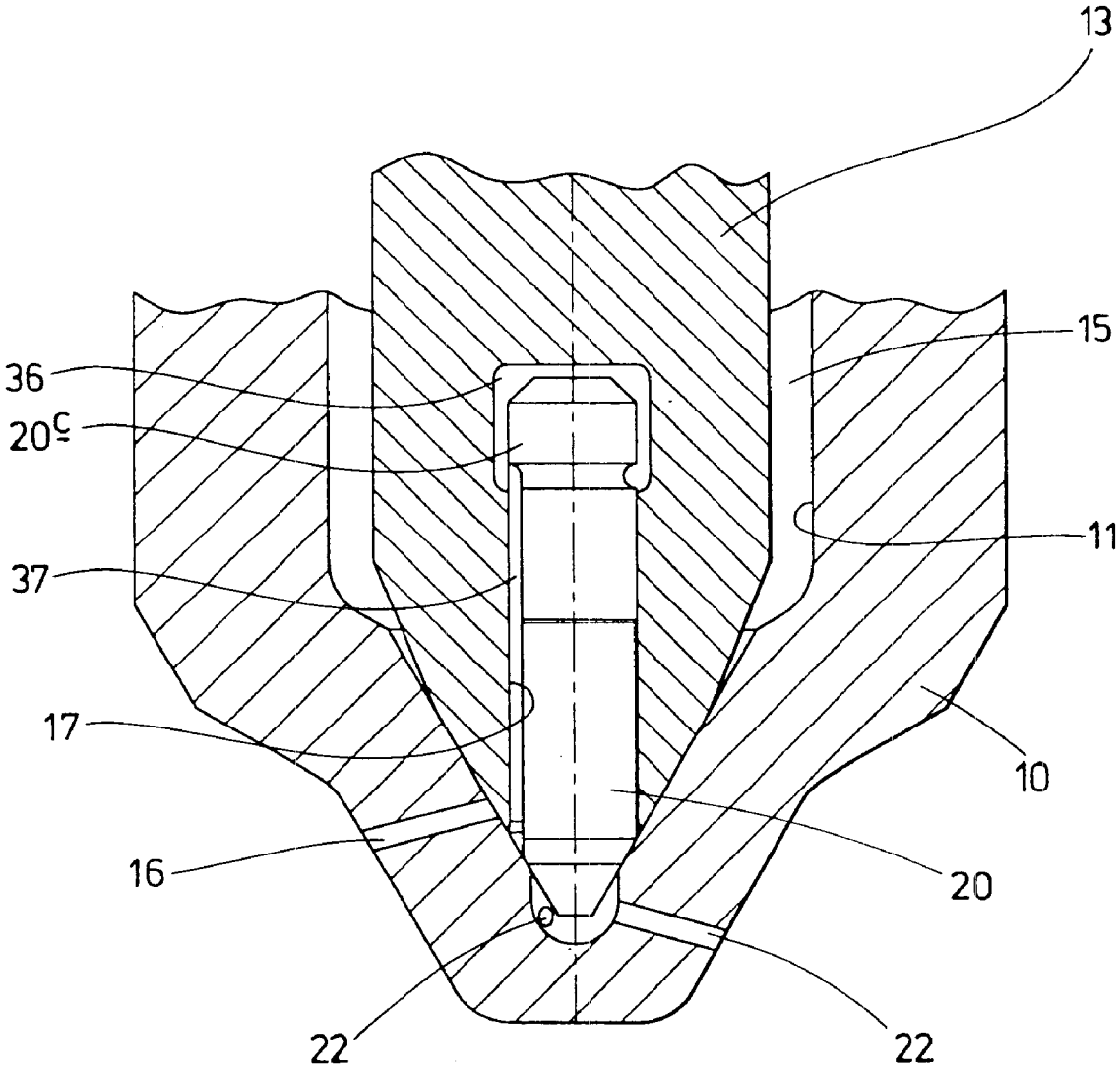

FIG. 15 illustrates an arrangement in which the pin is omitted, and instead a hydraulic link is provided between the inner valve needle 20 and the outer valve needle 13. As illustrated in FIG. 15, a chamber 36 of diameter greater than the remainder of the bore 17 is defined between the inner and outer valve needles 13, 20, the chamber 36 communicating through a channel 37 defined between the inner and outer valve needles 13, 20 with a position downstream of the first group of outlet openings 16. Within the chamber 36, the inner valve needle 20 includes a region 20*c* of diameter substantially equal to the diameter of the bore 17.

In use, upon movement of the outer valve needle 13 away from the frusto-conical end portion of the bore 11 through a small distance, fuel is able to flow to the chamber 36 along the channel 37, the flow of fuel to the chamber 36 maintaining the pressure applied to the upper surface of the inner valve needle 20 at a sufficient high level to ensure that the valve needle 20 does not move away from seating. If the lifting movement of the outer valve needle 13 is sufficient to result in the region 20*c* entering the bore 17, it will be appreciated that fuel can no longer flow to the chamber 36 as the channel 37 becomes closed. As a result, continued movement of the outer valve needle 13 reduces the fuel pressure within the chamber 36, and a point will be reached beyond which the inner valve needle 20 is able to lift away from the frusto-conical seating to permit fuel injection through both the first group of outlet openings 16 and the second group of outlet openings 22.

As with the arrangements illustrated in FIGS. 12 to 14, at the termination of injection, if the inner valve needle 20 has lifted from its seating, then the inner valve member 20 will return into engagement with the seating before the outer valve needle 13 returns to its closed position. As a result, it is ensured that for subsequent injections, the initial part of the injection occurs only through the first group of outlet openings 16.

Figure 16:
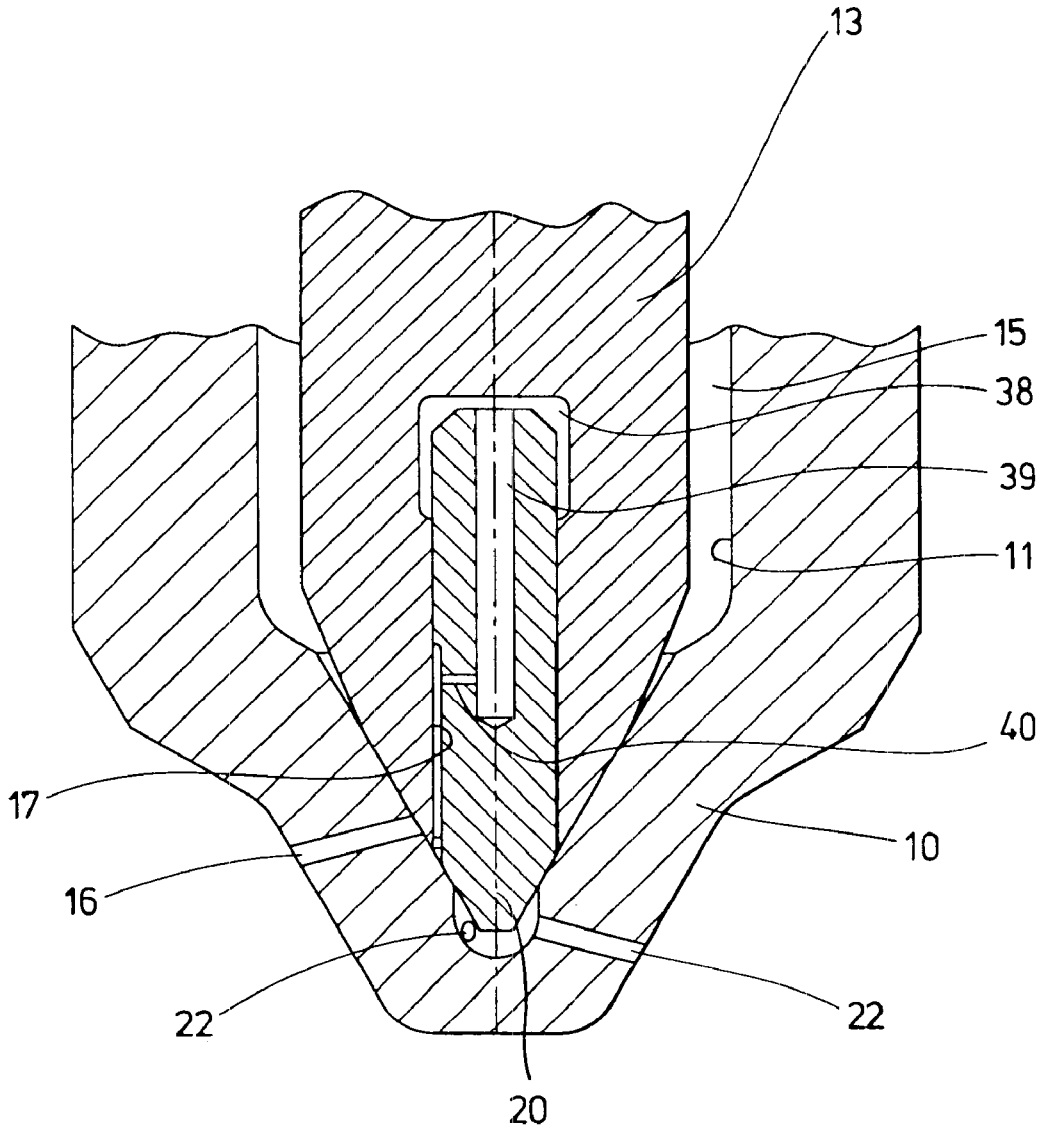

FIG. 16 illustrates an arrangement in which the inner valve needle 20 is slidable within the bore 17 formed in the outer valve needle 13 and defines therewith a chamber 38 which communicates with a portion of the bore 11 downstream of the first group of outlet openings 16 through a drilling 39 formed in the upper part of the inner valve needle 20, and a drilling 40 of restricted diameter. It will be appreciated, therefore, that the rate at which fuel is able to flow to the chamber 38, in use, is restricted. As a result, in use, if the movement of the outer valve needle 13 away from the seating is at a relatively low rate, then fuel will be able to flow to the chamber 38 at a sufficient rate to maintain the fuel pressure therein at a sufficiently high level to ensure that the inner valve needle 20 does not move away from the seating. However, if the rate at which the outer valve needle 13 moves is greater than a predetermined level, fuel will be unable to flow to the chamber 38 at a sufficiently high rate to maintain the pressure therein at a level sufficient to avoid injection through the second group of outlet openings 22, and instead the inner valve needle 20 will lift away from the seating, thus permitting fuel delivery through both the first group of outlet openings 16 and the second group of outlet openings 22.

At the end of injection, if movement of the inner valve needle 20 has occurred, then it will be appreciated that the inner valve needle 20 will return into engagement with the seating before the outer valve needle 13 returns to its closed position.

Clearly, the arrangement of FIG. 16 is designed such that movement of the inner valve needle 20 is dependent upon the rate of movement of the outer valve needle 13, and this can be controlled using an appropriate actuator arrangement.

During injection, if the inner valve needle 20 is lifted away from the seating, then as fuel is able to continue to flow to the chamber 38, the inner valve needle 20 will gradually return towards the seating. As a result, if the injection duration is greater than a predetermined duration, the final part of the injection may occur only through the first group of outlet openings 16.

Figure 17:
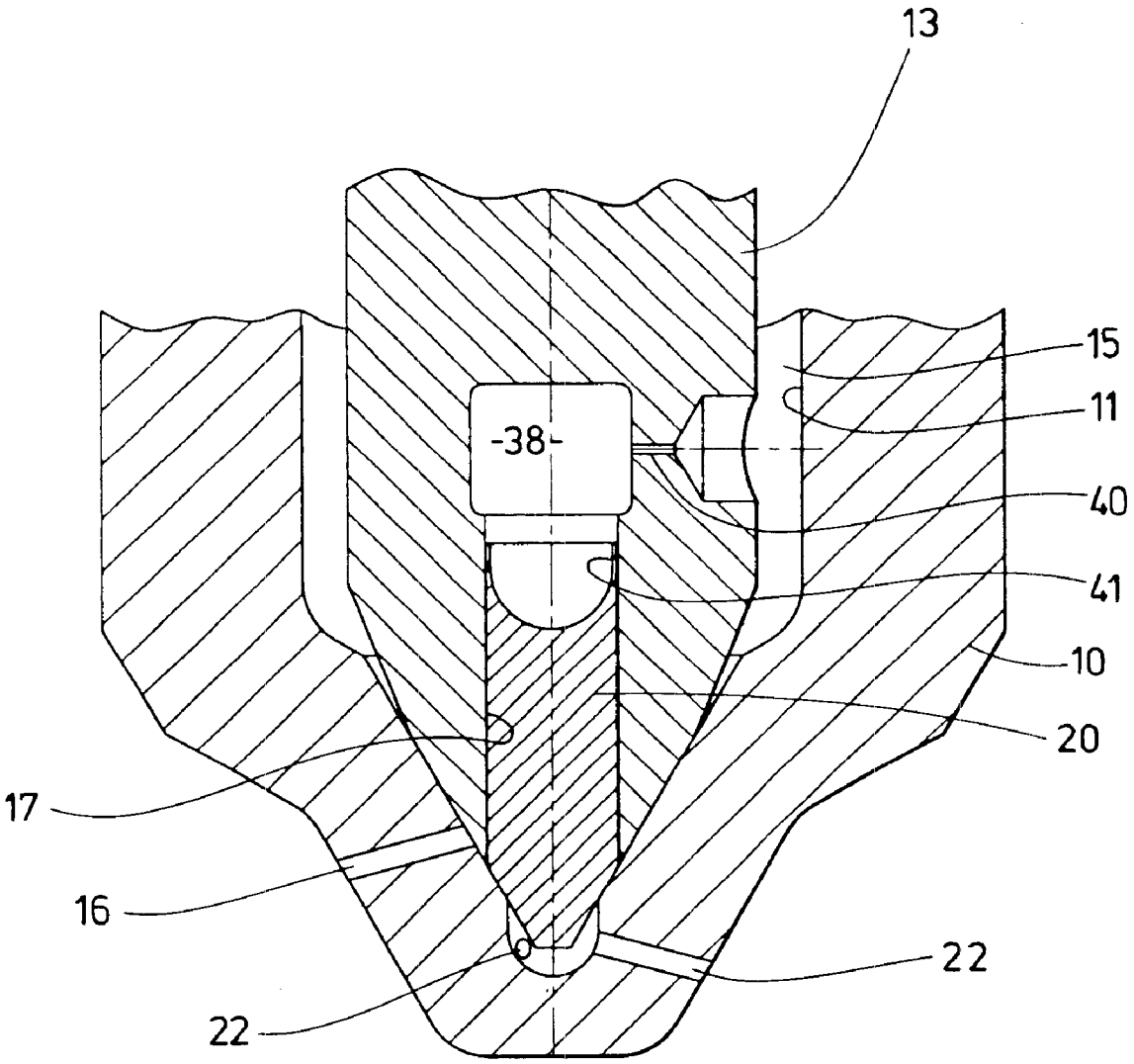

FIG. 17 illustrates an arrangement which operates in a manner similar to that illustrated in FIG. 16, but rather than providing the restricted fuel flow passage 40 in the inner valve needle 20, it is provided in the outer valve needle 13. As, in such an arrangement, the chamber 38 is charged with fuel directly from the chamber 15, and is not dependent upon the position of the outer valve needle 13, it is desirable to be able to minimise leakage between the inner and outer valve needles 13, 20, and this can be achieved by providing a recess 41 in the upper part of the inner valve needle 20, the recess 41 permitting deformation of the inner needle 20 to dilate the inner needle 20, reducing the size of any clearance between the inner and outer needles 13, 20.

Although the description hereinbefore suggests that the various embodiments are suitable for use with piezoelectric actuator arrangements, it will be appreciated that the injectors may be actuated using an alternative actuator arrangement. In the embodiments of FIGS. 1 to 15 control of injection through the second group of outlet openings 22 is dependent upon the total lift of the outer valve needle 13, and in the arrangements of FIGS. 16 and 17, it is dependent upon the rate of lift of the outer valve needle 13, and the actuator should be chosen accordingly.

We claim:

1. A fuel injector comprising a first, outer valve needle, a second, inner valve needle slidable within a passage provided in the outer valve needle, and load transmitting means whereby movement of the outer valve needle can be transmitted to the inner valve needle, the load transmitting means comprising a shoulder associated with the outer valve needle which is cooperable with the inner valve needle to transmit movement of the outer valve needle to the inner valve needle once the outer valve needle has moved beyond a predetermined distance, the shoulder being defined by a surface of a sleeve located within a bore formed in the outer valve needle, wherein the inner valve needle includes a region of increased diameter which is engageable with the shoulder, the region of increased diameter being arranged within an enclosed chamber defined by the bore formed in the outer valve needle such that fuel under high pressure acts on the inner valve needle, in use, to urge the inner valve needle against a seating.

2. An injector as claimed in claim 1, wherein the sleeve protrudes from the bore.

3. An injector as claimed in claim 2, wherein the outer valve needle is reciprocable within a further bore provided in a nozzle body, and wherein the sleeve includes a region which protrudes from the bore provided in the outer valve needle, the region being engageable with a first seating defined by the further bore.

4. An injector as claimed in claim 3, comprising a spring which is arranged within the enclosed chamber and which serves to bias the inner valve needle towards the first seating.

5. An injector as claimed in claim 1, wherein the inner valve needle is resiliently biased towards the first seating.

6. An injector as claimed in claim 1, wherein the passage is defined, at least in part, by a blind bore provided in the outer valve needle.

7. An injector as claimed in claim 1, wherein the load transmitting means restricts movement of the inner valve needle relative to the outer valve needle.

8. An injector as claimed in claim 1, wherein the outer valve needle is reciprocable within a further bore provided in a nozzle body and is cooperable with a first seating to control the supply of fuel to a first outlet, and wherein the inner valve needle is cooperable with a second seating to control the supply of fuel to a second outlet.

* * * * *